US007766193B2

(12) United States Patent
Stollmann et al.

(10) Patent No.: US 7,766,193 B2
(45) Date of Patent: Aug. 3, 2010

(54) DISPENSING DEVICE

(76) Inventors: Sophia Konstantina Stollmann, 12 Pearce Street, Double Bay, Sydney, NSW (AU) 2028; Paul Douglas Snelling, O'Carroll Road, Maungakaramea, Northland (NZ) 240

( * ) Notice: Subject to any disclaimer, the term of this patent is extended or adjusted under 35 U.S.C. 154(b) by 282 days.

(21) Appl. No.: 11/909,647

(22) PCT Filed: May 5, 2006

(86) PCT No.: PCT/NZ2006/000095

§ 371 (c)(1),
(2), (4) Date: Sep. 25, 2007

(87) PCT Pub. No.: WO2006/118479

PCT Pub. Date: Nov. 9, 2006

(65) Prior Publication Data

US 2009/0134184 A1 May 28, 2009

(30) Foreign Application Priority Data

May 5, 2005 (NZ) ..... 539854

(51) Int. Cl.
*B67D 7/84* (2010.01)

(52) U.S. Cl. ..... 222/175; 224/219

(58) Field of Classification Search ..... 222/78, 222/175; 224/148.1, 148.2, 148.4–148.6, 224/624, 218, 219, 222; 482/105; 272/119
See application file for complete search history.

(56) References Cited

U.S. PATENT DOCUMENTS

| | | | | | |
|---|---|---|---|---|---|
| 4,768,688 | A * | 9/1988 | Harrigan | 224/148.2 |
| 4,988,097 | A * | 1/1991 | Smith et al. | 482/105 |
| 5,072,935 | A * | 12/1991 | McWain | 482/105 |
| 5,938,089 | A * | 8/1999 | Abreu-Marston | 224/148.5 |
| 5,957,347 | A * | 9/1999 | White et al. | 224/148.1 |
| 6,581,811 | B1 * | 6/2003 | Schillaci | 224/148.2 |

FOREIGN PATENT DOCUMENTS

| | | | |
|---|---|---|---|
| DE | 29721646 | U1 | 3/1998 |
| DE | 10223600 | A1 | 12/2003 |
| JP | 11127920 | A | 5/1999 |
| WO | 8706438 | | 5/1987 |

* cited by examiner

*Primary Examiner*—Lien T Ngo
(74) *Attorney, Agent, or Firm*—Myozone Pty Ltd

(57) ABSTRACT

The invention consists in a dispensing device that can contain a dispensable preparation or product. The device comprises a wearable item including a body adapted and constructed to contain the dispensing product and allow it's dispensing therefrom or filling or refilling. The dispensing device is substantially ring-shaped with a gap in its circumference that is formed or manufactured as such. Also disclosed is refill/storage/display stand enabling the display of at least one dispensing device and/or refilling therefrom.

18 Claims, 11 Drawing Sheets

DISPENSING DEVICE

FIELD OF THE INVENTION

The invention relates to a dispensing device for cosmetics, pharmaceuticals, nutritional preparations and other kind of items or liquids. The invention is also directed particularly but not solely to a dispensing device refilling container and display stand.

BACKGROUND OF THE INVENTION

Carrying and applying cosmetics, pharmaceuticals, nutritional or other items can be challenging while travelling or even simply actively engaged in any sort of indoors or outdoors activity walking, climbing, swimming, skiing, tennis or cricket playing and even simply travelling are just some examples.

Normally a user needs to carry a separate container or device such as a bottle of water or a box with nutritional content, or a tube of sun-cream. This adds to the weight to be carried and depending on the shape of the container, it can become extremely inconvenient and cumbersome.

Active or sporting people need therefore a dispensing device that allows easy transportability, accessibility and use of it's content. Especially if immediate access to the content and—as in the case of certain pharmaceuticals or cosmetics—frequent reapplication is needed, the container must be easily carried, seen, accessed, opened, used, shut and stored.

In order to offer such a product at a market relevant price, it should be designed in a way to allow 1) seamless manufacturing in significant numbers and 2) semi-automated or fully automated filling in a hygienically acceptable manner.

A useful contents minimum can be 50 ml volume thus enabling sufficient usages.

There is also a need to also allow for easy dispensing of a minimum of 97% of it's contents in order to comply with all consumer protective regulations.

In general any such devices or containers do not always provide sufficient space to include a) the brand of it's manufacturer and most importantly b) all consumer relevant information as directions of usage and listing of all content ingredients, listing of expiry dates etc.

Consumer protection necessitates large quantity of information to appear on the dispensing device and to be easily accessible for the user/consumer. This data should appear on any dispensing device or container (and not only on it's packaging) thus providing sufficient space on the device or container for such information to be printed or labelled is a current problem with prior art devices. Any device not allowing for this space can be extremely difficult to market.

As any device that is carried on the body should be manufactured out of materials that are pleasant to the skin and do not lead to any type of allergies or have other side effects. This problem can be serious for many users.

Some devices are too hard to squeeze. Any chosen materials should allow for easy squeezibility of the device for dispensing the content whilst allowing the device to maintain it's form (materials should not lose "their memory") while nearly empty.

Materials compatibility is another problem wherein the contents (liquid, semi liquid or small items) in order to avoid eventual chemical reactions between the content and the device.

The environmental concerns of our time make it desirable for the chosen materials to be recyclable. For the same reason any dispensing device or container should allow refillability.

Any device being used in a water or wet environment can cause problems for such devices if they are not waterproofed in some way.

While one is actively engaged in an activity, any device opening should be such as to enable dispensing of appropriate volume of content and it's cap should be such as to allow easy and fast opening, easy accessibility of the content and should be attached so not to be lost during use.

An easy to carry, to use while on land, air or water, light, economical, water proof, refillable and fully recyclable device is a great solution to today's life style needs and environmental concerns.

Yet another problem with current dispensing devices is in providing for storage and refillability.

Displaying devices of such unusual form also pose practical difficulties for sellers as no conventional display tool can be used. Providing a space saving and easily accessible display is necessary. Refilling any such containers also poses problems of convenience and cost.

OBJECT OF THE INVENTION

The object of the invention is to provide an improved dispensing device or refilling container or display stand, which will obviate or minimise some if not all of the aforementioned problems in a simple yet effective manner or which will provide the public with a useful choice.

Statement of the Invention

Accordingly in a first aspect the invention consists of a dispensing device that can contain a dispensable preparation or product, being adapted for wearing, the dispensing device comprising a body being formed in a substantially ring shape with a gap on it's circumference and being adapted and constructed to store the product and allow dispensing therefrom or filling or refilling, wherein the dispensing device is formed or manufactured in the ring shape.

Preferably the device is a bracelet.

Preferably the device is shaped in such a way as to allow sufficient space for branding or labelling.

Preferably the body of the dispensing device is ring-shaped and adapted for wearing on any limb such as neck, wrist, arm, leg, ankle, waist etc or for being attached on any item such as sports bag, golf bag etc.

Preferably the device is made out of a material type that provides sufficient flexibility to enable one wearing it, twistability, squeezibility for better dispensing of it's contents and memory for keeping it's shape once empty.

Preferably the gap on it's circumference allows for the filling of the dispensing preparation.

Preferably the device body is hollow allowing for maximum volume with a minimum capacity of 50 ml.

Preferably the dispensing preparation included in the device can be a cosmetic, pharmaceutical, nutritional or other sort such as a cream, liquid, beverage, sweets or other.

Preferably a dispensing end includes a dispensing means which can be a cap of any sort that has at least one closable aperture.

Preferably the cap is non removable during use.

Preferably the device can be formed to any shape that allows a limb to hold it during a motion of the user.

Preferably the device's body allows for optional attachment of other items such as keys, trinket or jewellery.

Preferably the device is formed in a way to allow for industrial manufacturing.

Preferably the branding or labelling can be for a manufacturer's brand or for all user directions and for all content ingredients listings which can be clearly engraved or printed or labelled thereon.

Preferably the device is designed and shaped in a form that allows semi-automated or automated filling of the content in a highly hygienic manner.

Preferably the ends include at least one dispensing end.

Preferably the device is made of a material type that is compatible with all types of contents, Preferably the device is made of material allowing exposure to the sun, to high or low temperatures, is water proof and fully recyclable.

Preferably the device is made from materials that are non-irritating to the skin.

Preferably the device's form allows for both of it's edges to be held together by using an add on rope.

Preferably the opening means (gap) of the device comprises a pivoting or moving portion.

Accordingly in a second aspect the invention consists of a refill container wherein the refill container includes a shape adapted to hold or display at least one dispensing device, the dispensing device can contain a dispensable preparation or product whereby said dispensing device is adapted for wearing, the dispensing device comprising a body being formed in a substantially ring shape with a gap on it's circumference and being adapted and constructed to store the product and allow dispensing therefrom and the device is formed or manufactured in the ring shape wherein the refill container includes a dispensing means and is adapted to allow the storage and dispensing therein of a preparation or product.

Accordingly in a third aspect the invention consists of a display stand wherein the display stand is adapted to display at least one dispensing device which can contain a dispensable preparation/product whereby said dispensing device is adapted for wearing, the dispensing device comprising a body being formed in a substantially ring shape with a gap on it's circumference and being adapted and constructed to store the product and allow dispensing therefrom and the dispensing device is formed or manufactured in the ring shape wherein the display stand is shaped to allow the storage thereon of the dispensing device(s).

Preferably the display stand can be telescoping to allow for extension or reduction of the Height of for storage for more or less dispensing devices as desired.

Preferably the stand can also be a non hollow display device.

BRIEF DESCRIPTION OF THE DRAWINGS

Embodiments of the invention will now be described by way of example only with reference to the accompanying drawings of which:

FIG. 11 Is a plan view of embodiment II of a dispensing device with cap on.

DESCRIPTION OF THE INVENTION

As shown in FIGS. 1 to 28 there is a dispensing device that is shaped to be worn, be attached, and can be used to dispense it's contents or be filled or refilled. This dispensing device is particularly useful for people on the move, at work, sports or play indoors or outdoors.

Figure 9:
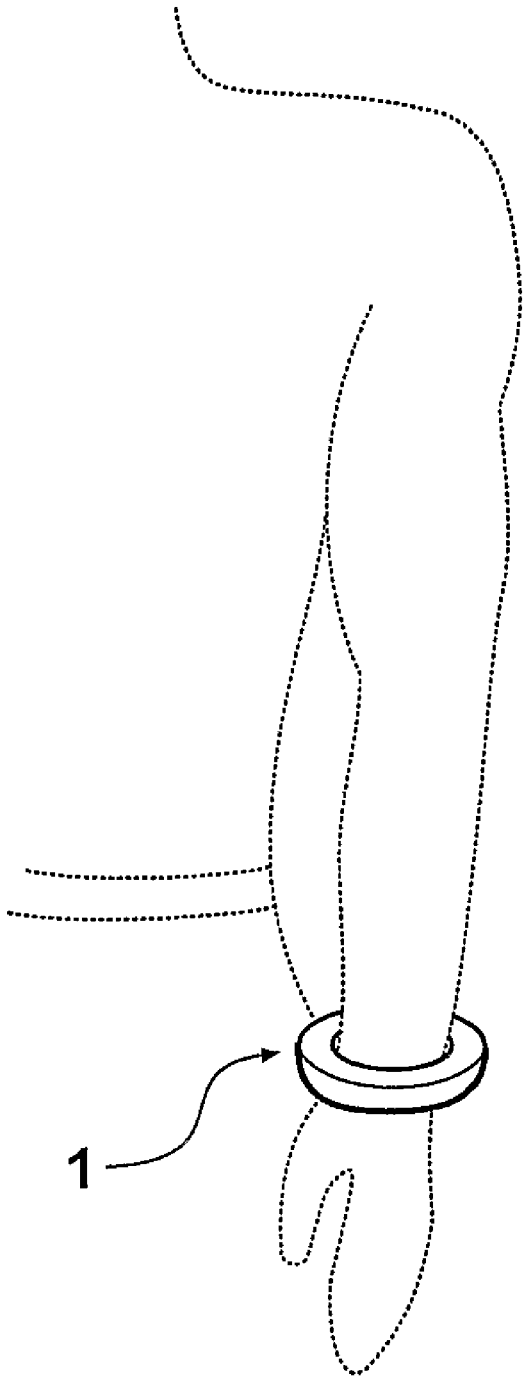
FIGS. 9 & 10 Are examples showing use of the dispensing device as a wearable item.
Figure 10:
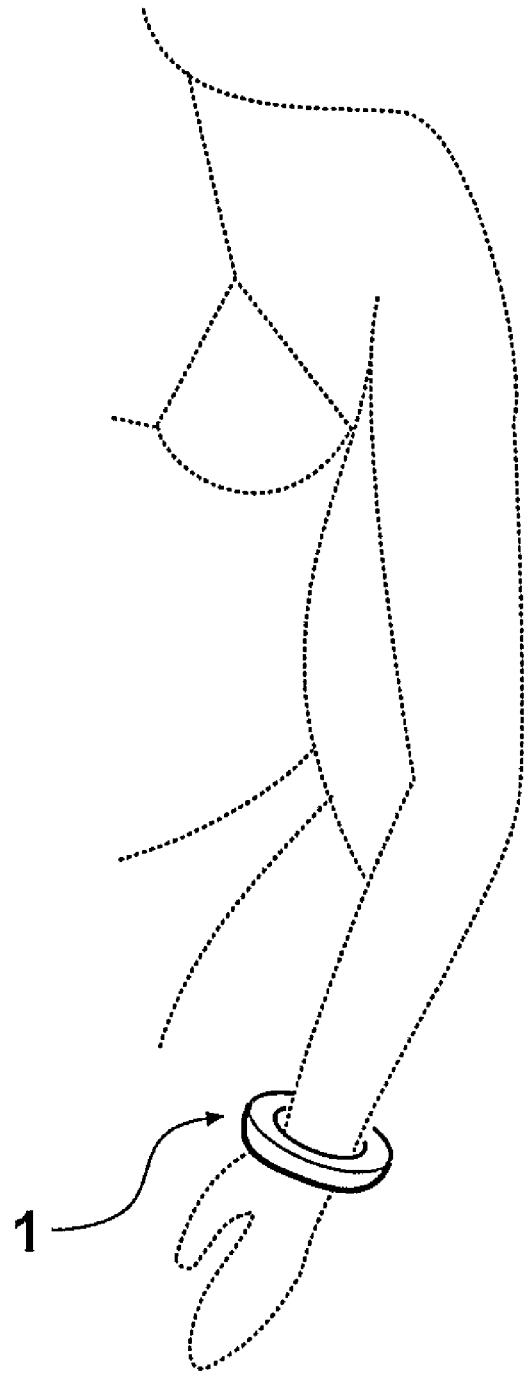
Figure 11:
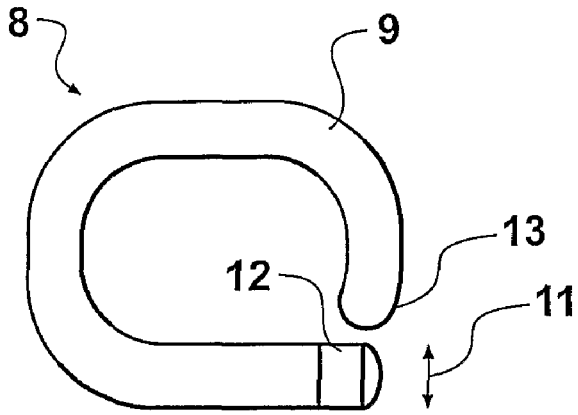

The dispensing device 1 of FIGS. 1-10 can be substantially ring shaped as formed or manufactured ready for wearing or dispensing therefrom, includes a body 2 forming a space 5 therebetween such that the dispensing device can be worn or be attached on another object by it's user. The dispensing device can be worn on any limb or other part of the body such as an arm, wrist, leg, ankle, waist or neck as shown in FIGS. 9 and 10. One example of the device is a bracelet. Alternatively the dispensing device can be shaped to be worn on other parts of the body such as the waist thereafter being a belt.

The dispensing device item body 2 is also constructed and adapted to form a hollow space (not labelled) for the containment and dispensing of it's contents (not shown). Body 2 has a shape that encloses a second space 5 to allow for a user to insert their body portion therein. For example, the body portion can be an arm wrist leg or ankle. This space 5 is not enclosed in all dimensions. Body 2 has ends 3 and 4 forming a circumferential space or gap 6 therebetween to assist in the fitting of the dispensing device item to any limb or attaching it on to another object and/or allowing filling or dispensing. The size and the position of gap 6 can vary as required.

Figure 1:
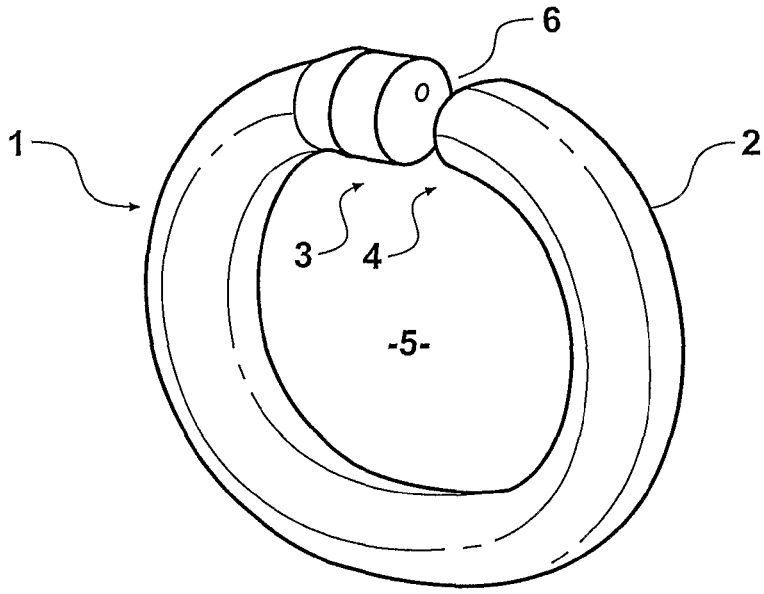
FIG. 1 Is a perspective view of embodiment I of a dispensing device.
Figure 2:
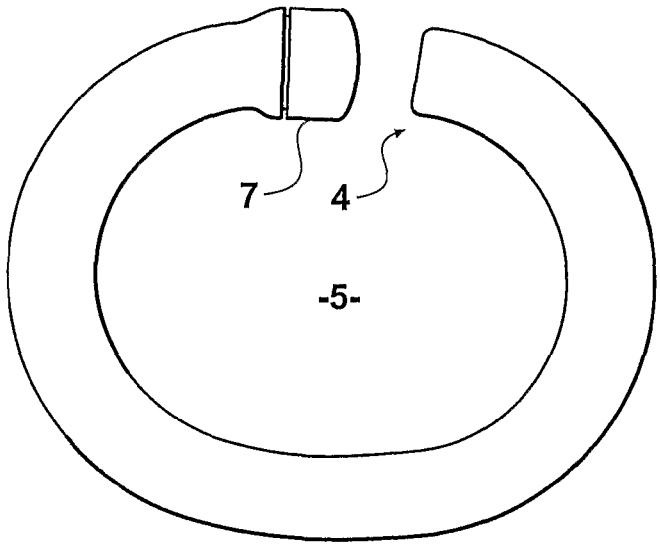
FIG. 2 Is a side view with partial skeletal view of the invention as in FIG. 1.
Figure 3:
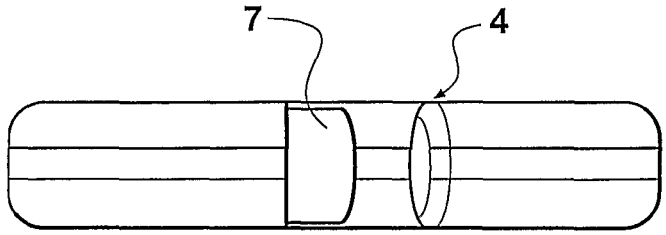
FIG. 3 Is a top end view of the dispensing device.
Figure 4:
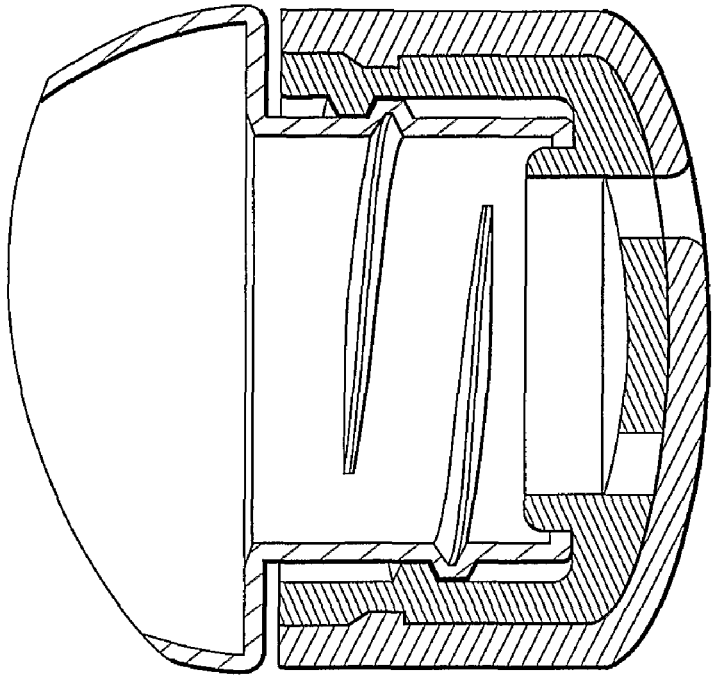
FIG. 4 Is a close up skeletal view of the dispensing end of the dispensing device.
Figure 5:
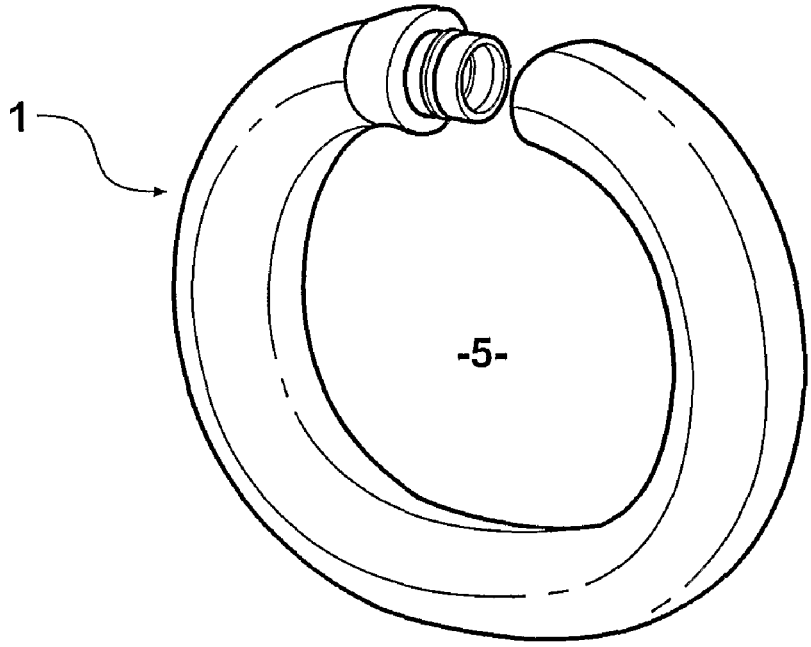
FIG. 5 Is a perspective view of the dispensing device without the cap.
Figure 6:
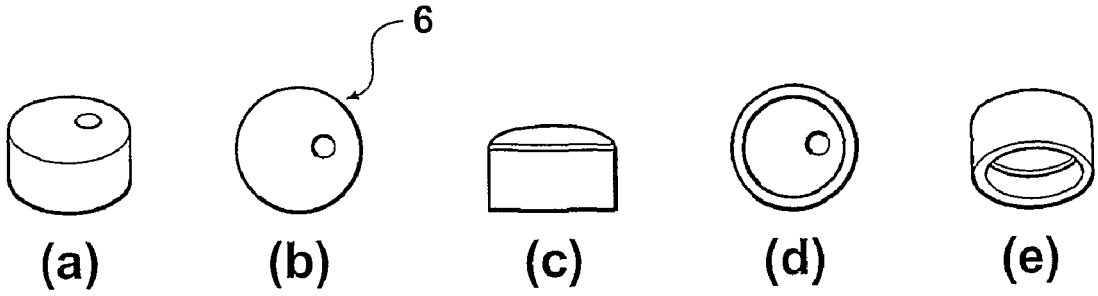
FIG. 6 Is a collection of views a) to e) showing the structure of one type of an outer cap.
Figure 7:
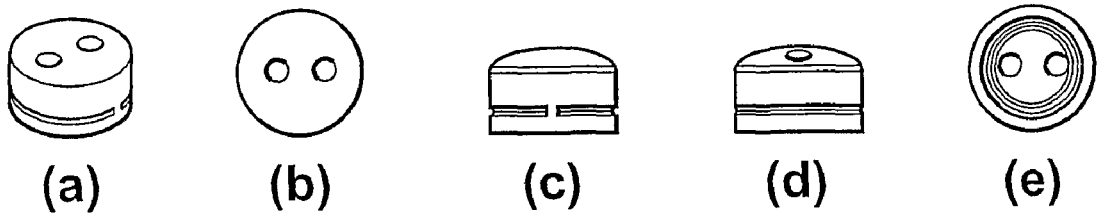
FIG. 7 Is a collection of views a) to e) showing the structure of an inner cap.
Figure 8:
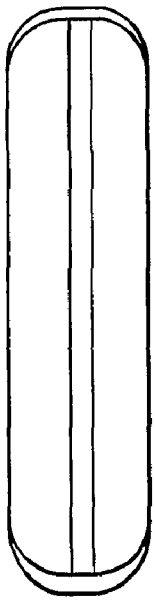
FIG. 8 Is a bottom view of the dispensing device.

As shown in FIGS. 2 and 4 at least one of the ends has a dispensing means 7. The dispensing means 7 can be any sort of cap but needs to be easily operable and openable for the contents to be dispensed without risk of leakage. Examples are shown but not labelled in FIGS. 4 and 6-8.

By squeezing the body, the contents can be released from within. The contents should be of such a consistency to enable removal therefrom. The contents of the dispensing device can be anything that the user desires. In this example it can be a cosmetic, pharmaceutical, nutritional or other preparation such as sun creams, moisturiser, or products such as sweets or beverages etc.

Also the actual dispensing allows for easy access and use while moving or travelling with no need for separate throw-away parts or protruding portions. Various methods of dispensing can be used depending on the kind of cap used.

The body can be made of any suitable material that enables flexibility, twistability, squeezibility while not deforming when the device is half full, is compatible with the contents and allows their easy dispensing. The material can be for example plastics, metal or rubber or any combination of the above. The body 2 should be sealable to prevent leaking. It can also be durable, lightweight, buoyant, UV resistant, water proof and recyclable.

The surface of body 2 can have sufficient space for product branding and labelling, complying with regulations on consumer information. The dispensing device can be sized and shaped according to the user's needs and the volume required. For example there can be a small size for children, a slightly larger size for teenagers and an adult size.

Dispensing device 1 can also be thought of as fashion accessory that can be coloured or shaped to be 'funky' or 'trendy', a throwaway or refillable item. In another option the device can be transparent for the contents to be visible. The device should be one piece for easy use during movement. If assembled of different parts these should not be readily removable during use. Any protruding parts should not be hazardous. Other attachments can also be included for items such as key rings, keys, lipsticks, phones etc.

FIGS. 11-21 show another embodiment of the invention. A dispensing device 8 is substantially a ring shaped body 9 forming a substantially enclosed space 10 therebetween, to allow it's wearing, for example on any body part or it's attaching on any object. This may be an arm, leg, wrist, waist or any object on which the dispensing device can be stored or displayed therefrom, as shown in FIGS. 9, 10 and 33 to 37.

Figure 12:
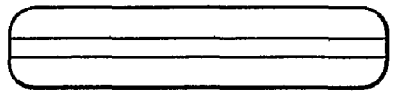
FIG. 12 Is a top view of the of the device of FIG. 11 allowing for engraving FIG. 13 Is a perspective top view of the device of FIG. 11 allowing for engraving.
Figure 13:
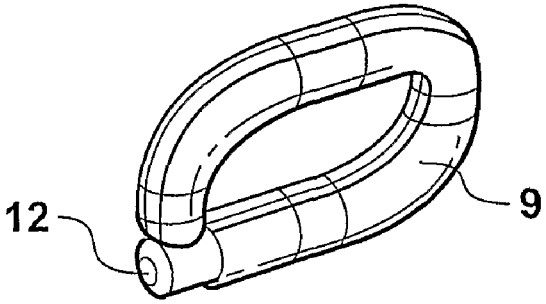
Figure 14:
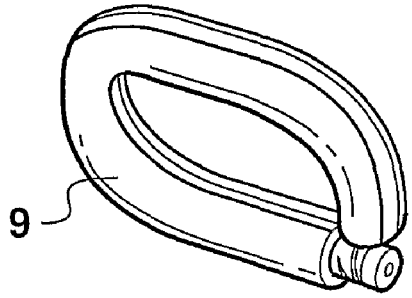
FIG. 14 Is a perspective view of the device of FIG. 11 without the cap.
Figure 15:
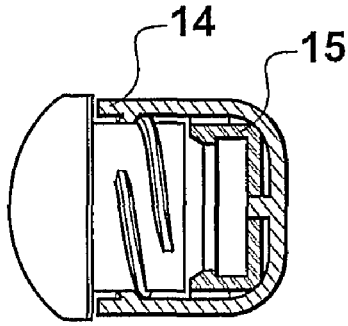
FIG. 15 Is a close up side view of the dispensing end of FIG. 11

FIG. 12 shows the surface of the dispensing device shaped to allow sufficient space for the engraving of a brand. FIG. 13 shows the space available for labelling of the dispensing device. FIG. 15 shows another dispensing means of the type having a cap made out of two parts, bodies 14 and 15, allowing dispensing of the contents through perfect alignment of their openings.

Other sealing means can also be included in the cap such as flanges and/or sealing rings which can be separately interfitted therewith.

Figure 16:
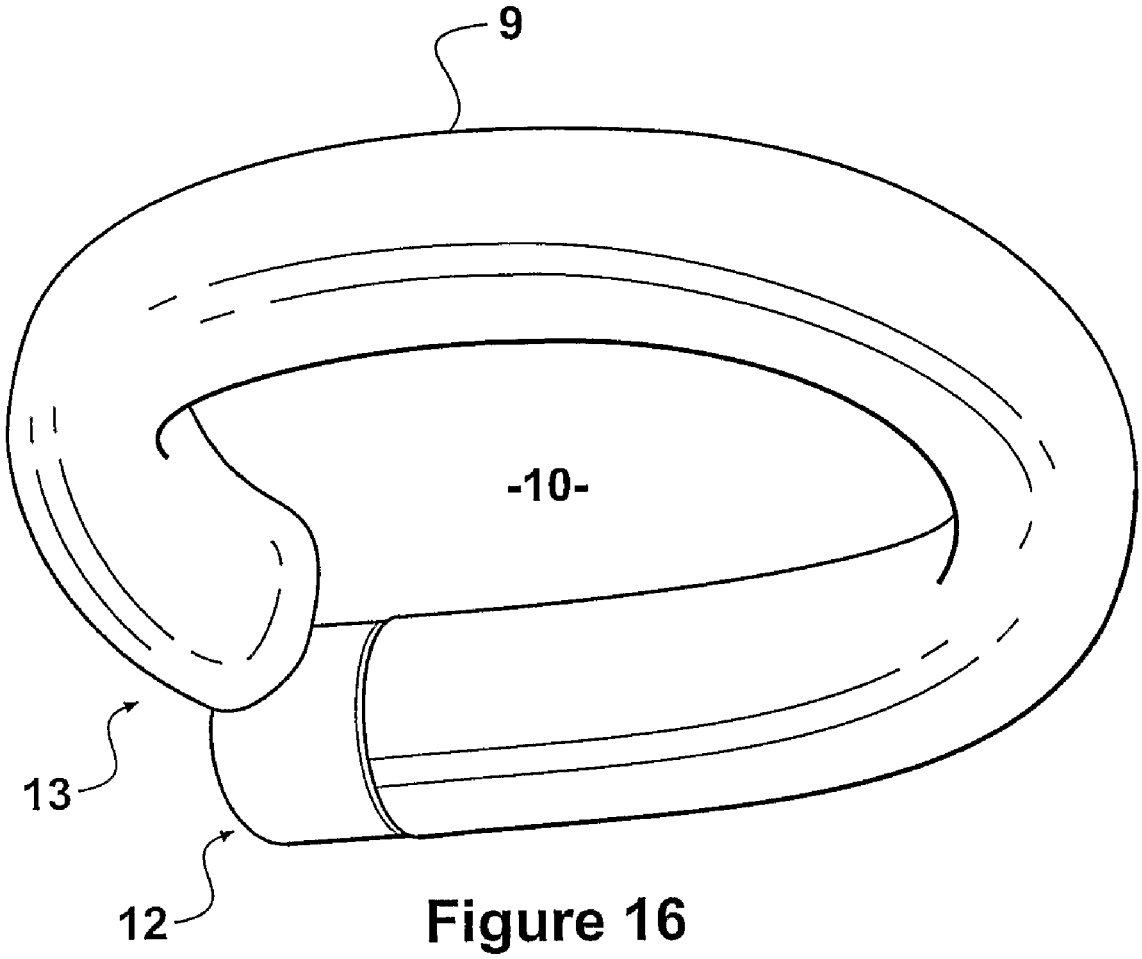
FIG. 16 Is a three dimensional perspective view of the device of FIG. 11.
Figure 17:
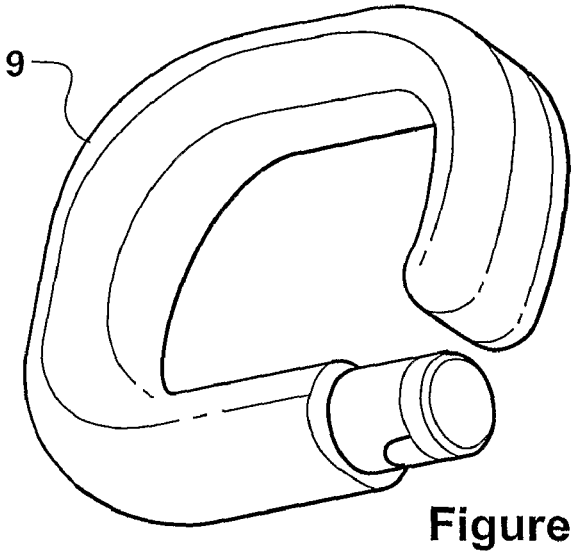
FIG. 17 Is a perspective view of the device of FIG. 11 with another type of cap.
Figure 18:
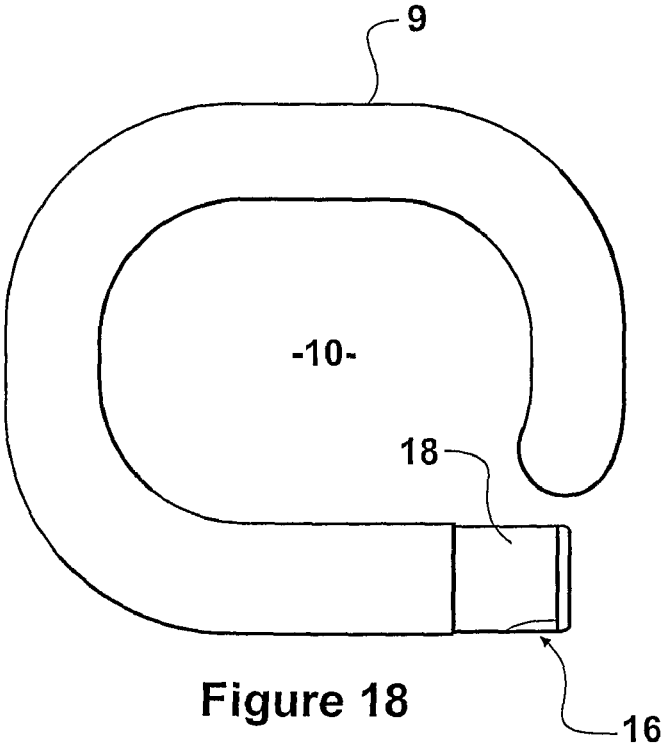
FIG. 18 Is a front view of the device of FIG. 17.
Figure 19:
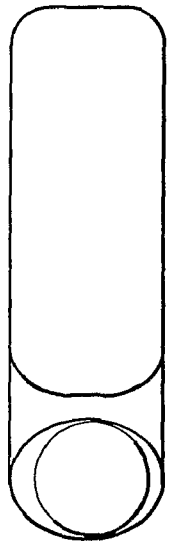
FIG. 19 Is an end view of the device of FIG. 17.
Figure 20:
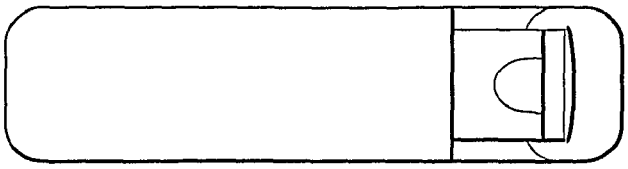
FIG. 20 Is another end view of the device of FIG. 17.
Figure 21:
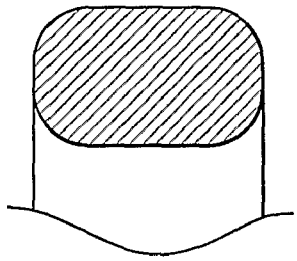
FIG. 21 Is a cross sectional view of the device of FIG. 17.
Figure 22:
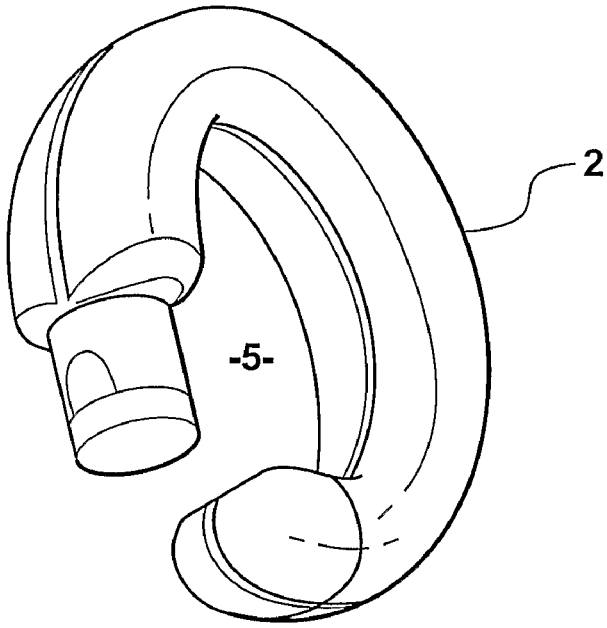
FIG. 22 Is a perspective view of embodiment III of a dispensing device with a cap.
Figure 23:
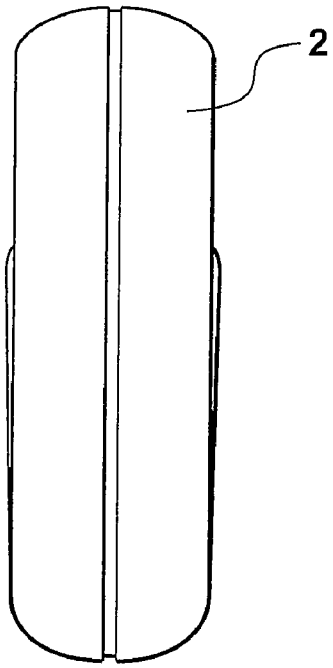
FIGS. 23 & 24 Are end view and side view of the device of FIG. 22.
Figure 24:
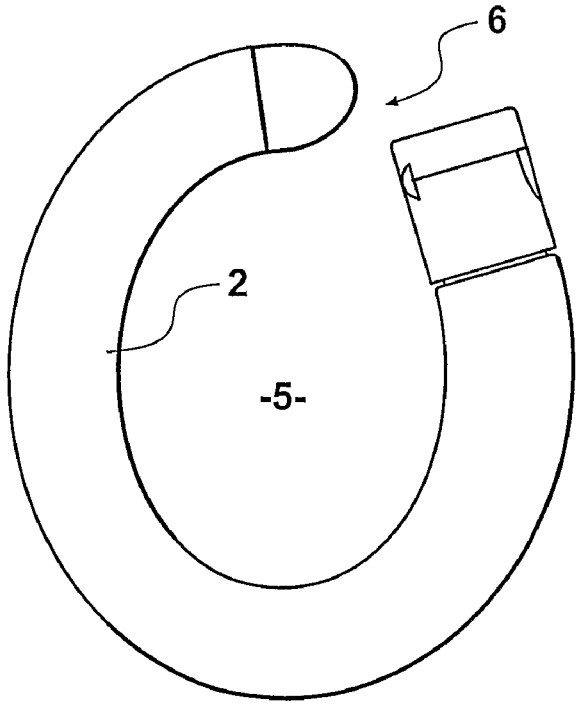
Figure 25:
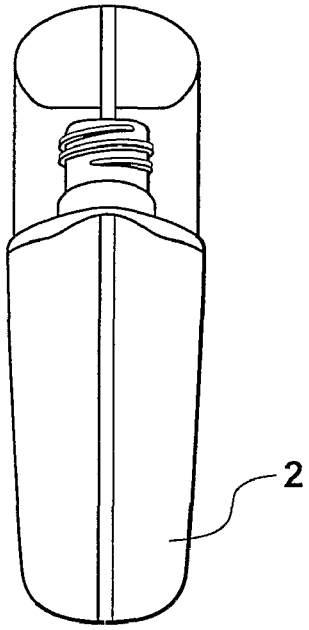
FIGS. 25-28 Are various views of the device of FIG. 22 without the cap.
Figure 26:
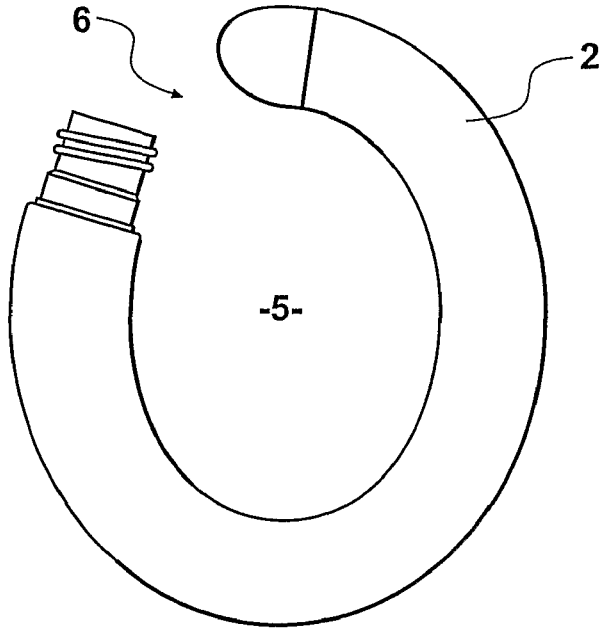

FIG. 16 shows the dispensing device in a three dimensional form with the space enabling brand engraving clearly indicated on body 9.

Body 9 can be shaped in any way that enables the wearing thereof. For example as a circle or an oval, or square or rectangle, or in any variation or combination thereof. As shown in FIGS. 11-28 the shape is not perfectly round but is almost oval. Body 9 has at least one dispensing end 12 and at least one closed end 13. In another variation there could be two dispensing ends. Body 9 has a cross section 11. Cross section 11 can be any cross sectional shape that enables dispensing and closing therefrom.

Additionally, body 9 can have other protuberances such as ribbing, outer ribbing, grip portions and even strengthening means to further enhance it. The device may also be impact and UV resistant.

Figure 27:
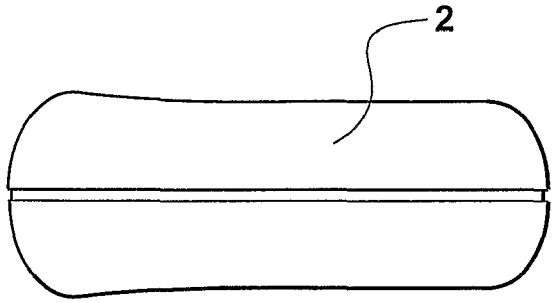
Figure 28:
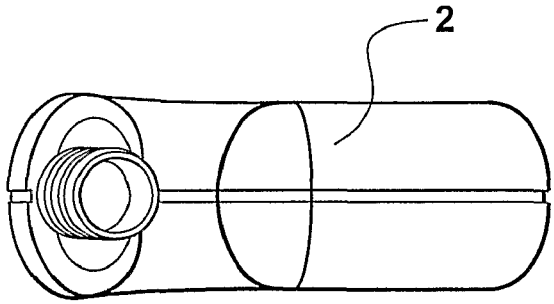
Figure 29:
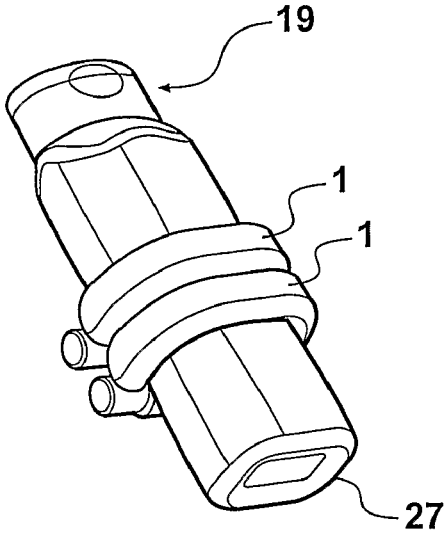
FIGS. 29-35 Are various views of a refill/storage/displaying stand being an openable container.
Figure 30:
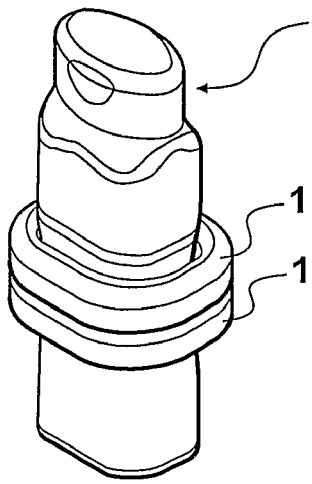
Figure 31:
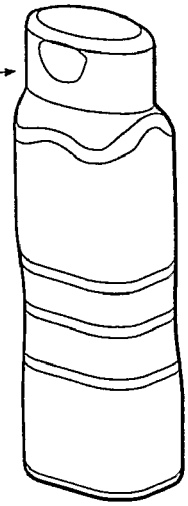
Figure 32:
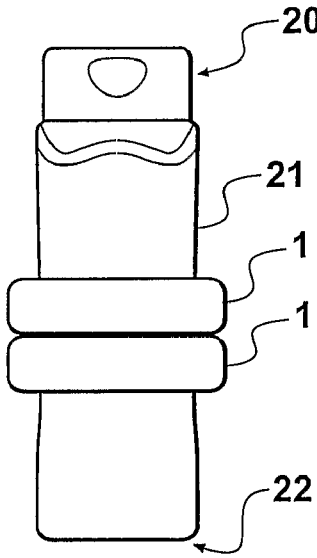
Figure 33:
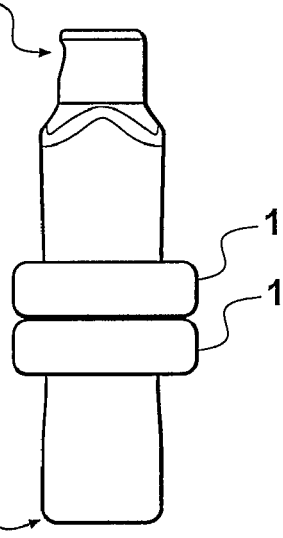

FIGS. 22-28 use the same notation as for FIGS. 1-10 and are further examples for the dispensing device. These figures show the rounded nature of body 2 to facilitate manufacturing and comfortable use. FIG. 27 is a bottom view of body 2.

This version of the dispensing device allows for a larger quantity of dispensing product or content to be held.

Refill Container as in FIGS. 29-35

FIGS. 29-35 are examples for a refill/storage/display stand assembly including a refill container having a body 20. Body 20 is of generally tubular shape, forming a hollow space for storage of cosmetics, medical, nutritional or other liquids to be eventually refilled into the dispensing device 1. In another option the refill container is shaped or adapted to serve as a combined or separate display means or removably hold at least one dispensing device 1 or can simply be used as a separate dispensing or refilling device.

Figure 34:
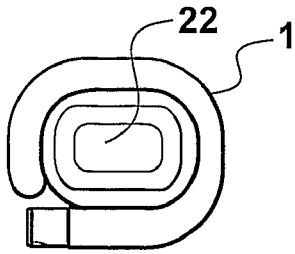
Figure 35:
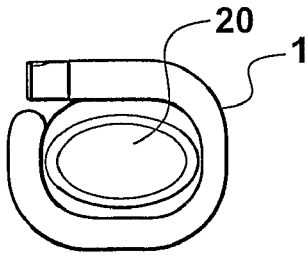

FIG. 34 is a top view of the container body 20 with dispensing devices while FIG. 35 is a bottom view of the same combination. Body 20 should be formed (see FIG. 33) in a way to allow say in this example at least one dispensing device(s) body 1 to be attached as shown on FIGS. 29-35.

FIGS. 29-33 show the refill/storage/display container body 20 with a dispensing means including a cover 19 which can be of any sort of cap and aperture enabling easy opening and dispensing. For example a flip-top cap can be used.

An assembly or kit can include the display stand shaped to removably hold at least one dispensing devices 1. For example, the dispensing device(s) 1 can hold or contain sun-cream while container 20 can contain either sun-cream to refill the dispensing devices 1, or after-sun moisturizer, or something completely unrelated such as a beverage.

In terms of materials the refill/storage/display stand container can be made of any sort as long these allow flexibility, twistability, squeezibility, no loss of shape, compatibility with the contents, are waterproof and recyclable.

Figure 36:
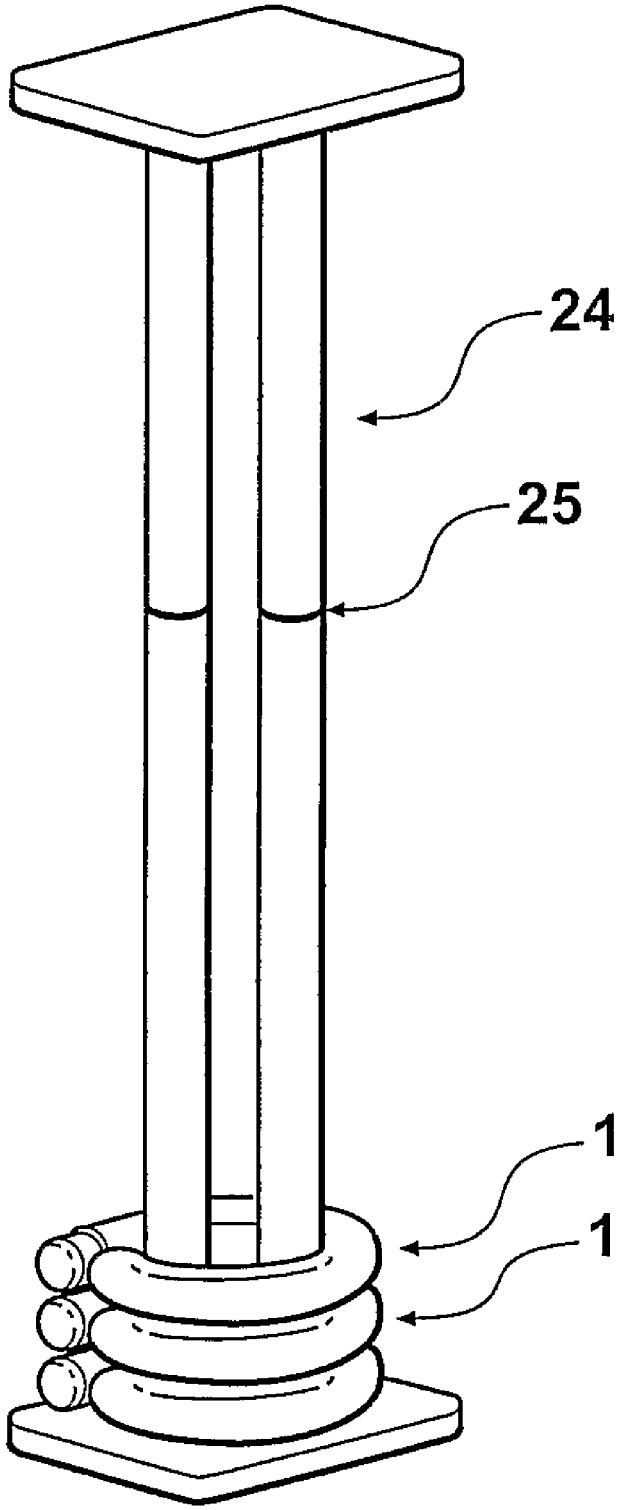
FIG. 36 Is a perspective front view of another display stand.

The Display Stand as in FIG. 36

FIG. 36 shows numerous dispensing devices 1 having a body 9 on a display stand having a body 24 shaped and adapted to removably hold at least one dispensing device 1 and said stand to be used for displaying and/or space saving storage purposes in a retail or other environment. Body 24 can be shaped to hold the various sized and variable number of dispensing devices (Body 9). It can be of telescopic form having adjustment means 25 allowing for it's height to be easily altered (reduced or extended) and adjustably fixed in order to enable stacking of a variable number of dispensing devices (Body 9).

Body 24 can be of different sorts of material as plastic, Plexiglas, steel, aluminium or other.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

Throughout the description and statement of invention of this specification the word "comprise" and variations of that word, such as "comprises" and "comprising", are not intended to exclude other additives, components, integers or steps.

A) The Dispensing Device Can Have at Least One of the Following Advantages:

1. combines practicality with fashion
2. easy to wear and/or easy to carry
3. reminds and allows easy reapplication of the contents
4. is simple to operate while engaged in any activities 5. is economical to manufacture
6 is of lightweight and robust construction.
7. allows semi- or full automated filling
8. allows for engraving and labelling space
9. is waterproof, recyclable and refillable
10. is not easy to lose
11. can be manufactured at realistic cost's
12. easily attached to another item
13. allows secure containment of the contents B) The Refill/Storage/Display Stand or Container Can Have at Least One of the Following Advantages 1. allows to easily carry up to 750 ml content of cosmetic, pharmaceutical, nutritional or other.
2. allows to display/store at least 2 dispensing device
3. allows to refill the dispensing device C) The Display Stand Can Have a Least One of the Following Advantages:

1. innovative and distinctive appearance.
2. allows easy accessibility of the products displayed
3. telescopic function to easily modifying it's size
4. space saving form for minimum shelf space

What we claim is:

1. A wearable product dispensing device comprising an unclosed loop of material defining a chamber adapted to receive a product, having a first end and a second end, each respective end being separated by a space defining the unclosed portion of the loop, whereby the device can be moved from a first unbiased position to a second biased position to temporarily expand the pre-existing space to enable the device to fitted around a portion of a wearer and remain worn by a wearer when the device is allowed to move back into its unbiased position, the device being provided with a means to dispense a product to be contained within the chamber that is located at one end of the device and wherein respective principal axes at each end of the device in its unbiased state are substantially orthogonal and bisecting with respect to each other.

2. A device as claimed in claim 1, wherein the device is provided with a resealable cap, the cap and device being provided with complementary means of engagement enabling the cap to be demountably fitted to the end of the device containing the means to dispense a product.

3. A device as claimed in claim 2, wherein the cap is a screw on flip top cap, comprising at least one closeable aperture.

4. A device as claimed in claim 1, wherein a virtual principal axis of the non cap containing end bisects a real or virtual principal axis of the end containing the cap substantially through the cap or displaced away from the device.

5. A device as claimed in claim 1, wherein the device is a bracelet.

6. A device as claimed in claim 1, wherein the loop of material is such to allow for branding and labelling.

7. A device as claimed in claim 1, wherein the device is made of a resilient material that allows twistability and squeezibility of the device.

8. A device as claimed in claim 1, so adapted as to allow for the optional attachment of other items such as keys, trinkets or jewellery.

9. A wearable product dispensing device as claimed in claim 1 containing product.

10. A device as claimed in claim 1, wherein the product can be selected from the group comprising a cosmetic, a pharmaceutical, a sun screen and a nutritional preparation.

11. A wearable product dispensing device comprising:

a body forming an openable loop of flexible material including a wall defining an internal chamber capable of receiving a product, the device having a first end and a second end, one of which ends provided with a cap for filling or dispensing the product, each respective end being separated by a space defining an open portion of the loop, whereby an end of the device can be displaced relative to the other end to temporarily expand the loop and then allow the device to move back to its original position to enable the device to be fitted to a wearer and remain worn by a wearer when the device is allowed to move back into its original position;

wherein the ends of the device are arranged so that the end provided with the cap is oriented in a direction relative to the other end such that the other end does not obstruct operation of the cap and such that if either one of the ends was extended towards the other end, the respective ends would not meet in opposing alignment;

wherein respective principal longitudinal axes projected from each end of the device in its unbiased state are substantially orthogonal and bisecting with respect to each other.

12. The device of claim 11 wherein at least part of the asymmetric loop has a linear portion.

13. The device of claim 12, wherein the cap is further defined as a resealable sealing cap, which enables dispensing of the product from the device.

14. The device of claim 13 further comprising a threaded portion for fitting the cap to the end of the body.

15. The device of claim 14 wherein the cap includes at least one closeable aperture.

16. The device of claim 15 wherein the loop is arranged to enable the device to form a bracelet.

17. The device of claim 16 wherein the product can be extruded from the device by squeezing or twisting the wall of the device.

18. The device of claim 17 wherein the product can be selected from the group comprising a cosmetic, a pharmaceutical, a sun screen and a nutritional preparation.

* * * * *